US008253522B2

(12) United States Patent
Kobayashi et al.

(10) Patent No.: US 8,253,522 B2
(45) Date of Patent: Aug. 28, 2012

(54) COIL COMPONENT HAVING WIRE-SUPPORT MEMBER

(75) Inventors: Katsumi Kobayashi, Tokyo (JP); Yutaka Hatakeyama, Tokyo (JP); Nobuo Kitajima, Tokyo (JP)

(73) Assignee: TDK Corporation, Tokyo (JP)

( * ) Notice: Subject to any disclaimer, the term of this patent is extended or adjusted under 35 U.S.C. 154(b) by 15 days.

(21) Appl. No.: 12/852,745

(22) Filed: Aug. 9, 2010

(65) Prior Publication Data

US 2011/0050378 A1 Mar. 3, 2011

(30) Foreign Application Priority Data

Aug. 28, 2009 (JP) ..... 2009-197856

(51) Int. Cl.
*H01F 27/30* (2006.01)
*H01F 27/29* (2006.01)

(52) U.S. Cl. ..... 336/198; 336/208; 336/192

(58) Field of Classification Search ..... 336/192, 336/196, 182, 198, 208
See application file for complete search history.

(56) References Cited

U.S. PATENT DOCUMENTS 4,352,080 A * 9/1982 Mitsui et al. ..... 336/83
4,549,158 A * 10/1985 Mitsui et al. ..... 336/83
4,716,394 A * 12/1987 Gordon ..... 336/192
7,017,851 B2 3/2006 Matsuura et al.
7,061,358 B1 * 6/2006 Yang ..... 336/198
2004/0155542 A1 8/2004 Matsuura et al.
2007/0126542 A1 * 6/2007 He et al. ..... 336/83

FOREIGN PATENT DOCUMENTS

| | | |
|---|---|---|
| JP | U-48-000049 | 1/1973 |
| JP | U-55-71505 | 5/1980 |
| JP | U-60-190019 | 12/1985 |
| JP | U-61-112615 | 7/1986 |
| JP | A-8-69923 | 3/1996 |
| JP | A-2004-179498 | 6/2004 |

OTHER PUBLICATIONS

Aug. 25, 2011 Office Action issued in Japanese Patent Application No. 2009-197856 (with translation).

* cited by examiner

*Primary Examiner* — Mohamad Musleh
*Assistant Examiner* — Mangtin Lian
(74) *Attorney, Agent, or Firm* — Oliff & Berridge, PLC

(57) ABSTRACT

A coil component includes a bobbin having a core part and a flange. The flange has a first surface on a first side and a second surface on a second side. The first surface of the flange is attached to an axial end of the core part. An end of a wire is electrically connected to a metallic terminal of a terminal-mounting member disposed on the flange. The flange is formed with a notch at a position near the terminal-mounting member, and the notch extends from a peripheral edge of the flange toward the core part. A segment of the wire near the end thereof extends from the second side to the first side of the flange through the notch and further to the core part, and this segment of the wire is hooked around the wire-supporting member in the notch.

8 Claims, 9 Drawing Sheets

COIL COMPONENT HAVING WIRE-SUPPORT MEMBER

CROSS REFERENCE TO RELATED APPLICATION

This application claims priority from Japanese Patent Application No. 2009-197856 filed Aug. 28, 2009. The entire content of the priority application is incorporated herein by reference.

TECHNICAL FIELD

The present invention relates to a coil component, and particularly to a coil component including a bobbin and coils formed of wires wound around a core part of the bobbin.

BACKGROUND

There has been provided a coil component including a bobbin and coils formed of wires. The bobbin has a core part formed substantially cylindrical in shape and a pair of flanges. Each of the flanges has a first surface attached to an axial end of the core part.

One of the flanges is provided with a plurality of terminal-mounting parts on a second surface of the flange opposite to the first surface, and is formed with notches near the terminal-mounting parts. Each notch extends from the peripheral edge of the flange to a position near the core part. Each wire is electrically connected at its end to a metallic terminal of the corresponding terminal-mounting part, extended from the second surface side to the first surface side of the flange through the notch and further to the core part, and wound about the core part many times such that the wound parts align in the axial direction of the core part, thereby forming the coil.

SUMMARY

In this configuration, a part of each wire past the notch bends substantially at a right angle and extends along the first surface to the core part. Here, the wire does not bend at a rigid right angle, but rather bends along a curve. Thus, the curved portion of the wire protrudes away from the first surface of the flange in the axial direction of the core part. When winding the wire about the core part, the protruding portion of the wire causes problems in the alignment of the winding, and the coil in this area may bulge in the axial direction of the core part, i.e., push the winding in the axial direction away from the first surface. This makes it difficult to produce a coil component with a reduced height in the axial direction of the core part.

In view of the foregoing, it is an object of the invention to provide a coil component having a structure capable of minimizing problems in the winding alignment of wires constituting coils to allow for a reduction in the height of the coil component with respect to the axial direction of the core part.

In order to attain the above and the other objects, the invention provides a coil component including a bobbin and at least one wire. The bobbin includes a core part formed substantially cylindrical in shape and having an axial end, a flange having a first surface on a first side and a second surface on a second side opposite to the first side with respect to a first direction, a plurality of terminal-mounting members, and a wire-supporting member. The first surface of the flange is attached to the axial end of the core part. Each of the terminal-mounting members is disposed on the flange and has a metallic terminal. The at least one wire is wound about the core part to form a coil, and each of the at least one wire has a first end and a second end. The at least one wire includes a particular wire. Each of the metallic terminals is in one-to-one correspondence with each of the first and second ends of the at least one wire, and each of the first and second ends of the at least one wire is electrically connected to a corresponding one of the metallic terminals. The flange is formed with a notch at a position near a first one of the terminal-mounting members. The notch extends from a peripheral edge of the flange toward the core part. The wire-supporting member is disposed in the notch at a position closer to the second surface than the first surface in the first direction, and extends in a second direction from the peripheral edge of the flange toward the core part. The first segment of the particular wire near the first end thereof extends from the second side to the first side of the flange through the notch and further to the core part. The first segment is hooked around the wire-supporting member in the notch.

BRIEF DESCRIPTION OF THE DRAWINGS

In the drawings;

FIG. 9(*b*) is a right-side view of a part of a coil component according to still another modification of the embodiment.

DETAILED DESCRIPTION

Figure 1:
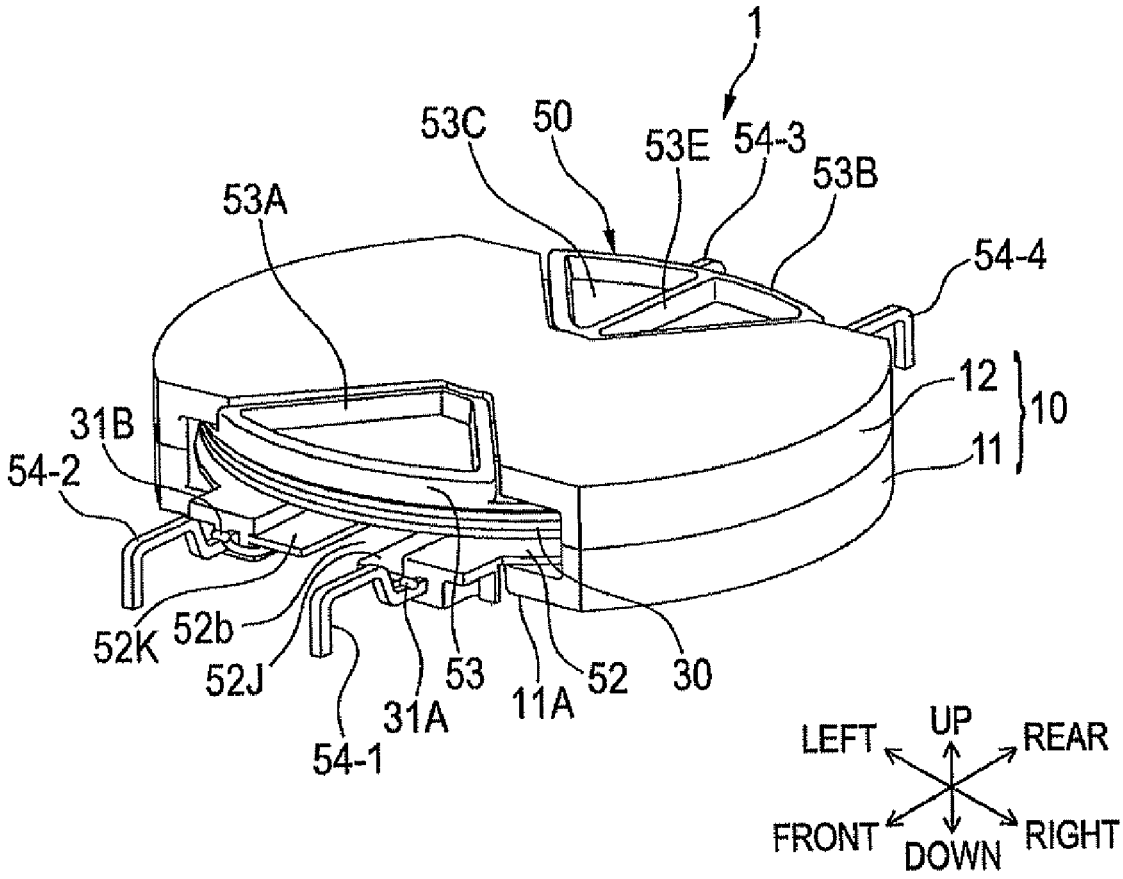
FIG. 1 is a perspective view of a coil component according to an embodiment of the invention.

A coil component 1 according to an embodiment of the present invention will be described with reference to FIGS. 1 through 7. The coil component 1 is more specifically a choke coil for use in power factor correction (PFC). As shown in FIG. 1, the coil component 1 includes a core 10, wires 30, and a bobbin 50. In a plan view, the coil component 1 is substantially elliptical in shape.

Note that in order to facilitate the description of the embodiment, the terms "upward," "downward," "upper," "lower," "above," "below," "rear," "front," "right," "left" and the like will be used throughout the description assuming that the coil component 1 is disposed in an orientation shown in FIG. 1, where the minor axis of the elliptical coil component 1 extends in a front-rear direction, the major axis in a right-left direction, and an axis orthogonal to both the minor and major axes in an up-down direction. The dimension of the coil component 1 in the right-left direction is approximately 44 mm; the dimension of the coil component 1 in the front-rear direction is approximately 40 mm; and the height of the coil component 1 in the up-down direction is approximately 8.6 mm.

The core 10 includes a first magnetic core 11 and a second magnetic core 12 formed of ferrite. Since the first and second magnetic cores 11 and 12 have the same shape, only the first magnetic core 11 will be described below.

Figure 2:
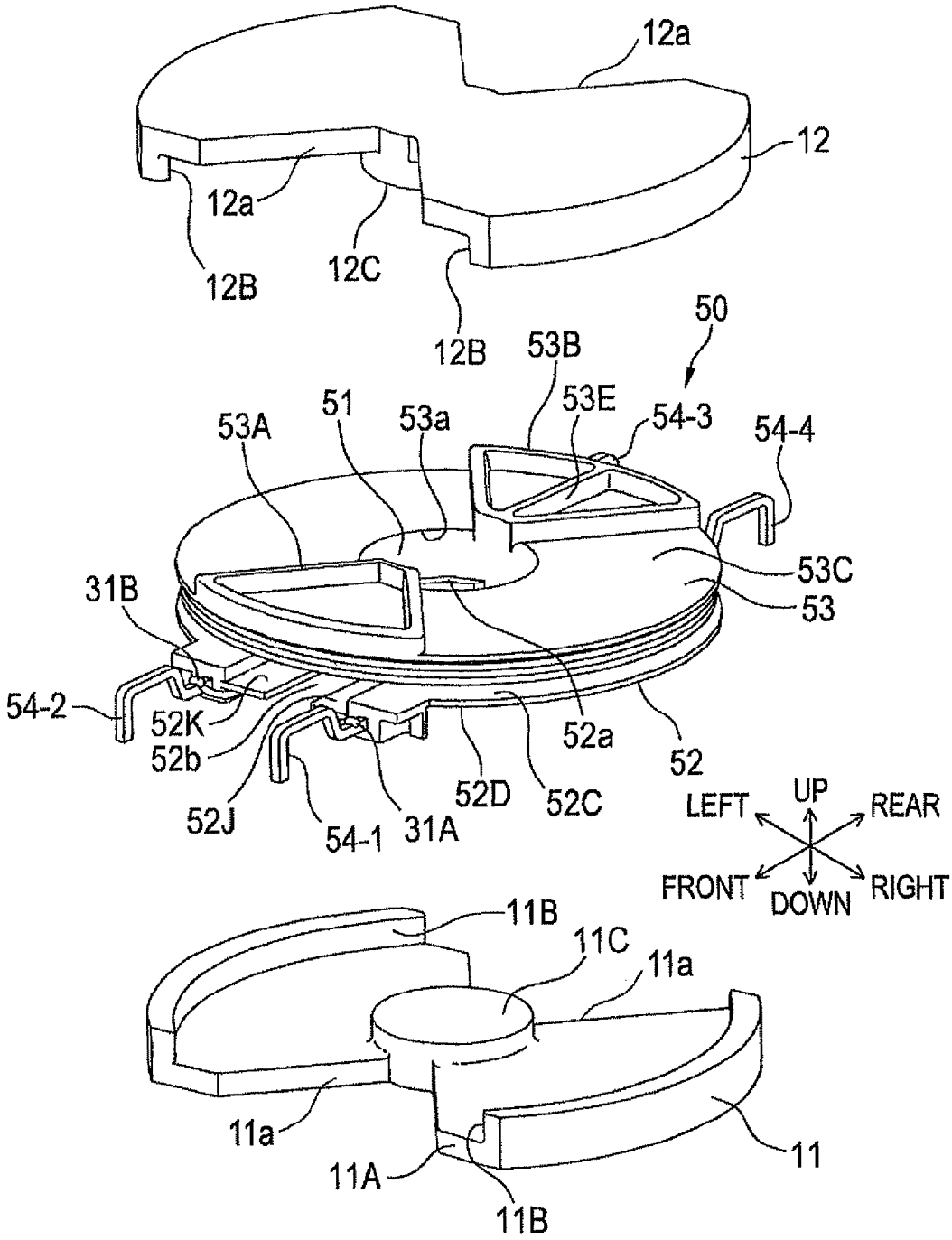
FIG. 2 is an exploded perspective view of the coil component shown in FIG. 1.

As shown in FIG. 2, the first magnetic core 11 has a plate part 11A, a pair of edge protrusions 11B, and a center protrusion 11C. The plate part 11A is formed substantially in an hourglass shape by forming a pair of large substantially fan-shaped notches 11*a* in diametrically opposing sides of a substantially circular plate shape so that the width of the plate part 11A in the front-rear direction narrows greatly toward the center in the right-left direction. The protrusions 11B are formed along substantially arc-shaped peripheral edges of the plate part 11A so as to protrude upward. The center protrusion 11C is substantially columnar shaped and protrudes upward from the center of the plate part 11A. When the coil component 1 is assembled as shown in FIG. 1, endfaces of the edge protrusions 11B oppose and contact respective endfaces of edge protrusions 12B of the second magnetic core 12, and an endface of the center protrusion 11C opposes and contacts an endface of a center protrusion 12C of the second magnetic core 12.

As shown in FIG. 2, the bobbin 50 includes a core 51 and a pair of flanges 52 and 53. The core 51 is substantially cylindrical in shape. The flanges 52 and 53 are formed substantially in a disk-shape and connected to respective axial ends of the core 51. Through-holes 52*a* and 53*a* are formed in center positions of the flanges 52 and 53, respectively, and communicate with an inner space of the core 51.

Figure 3:
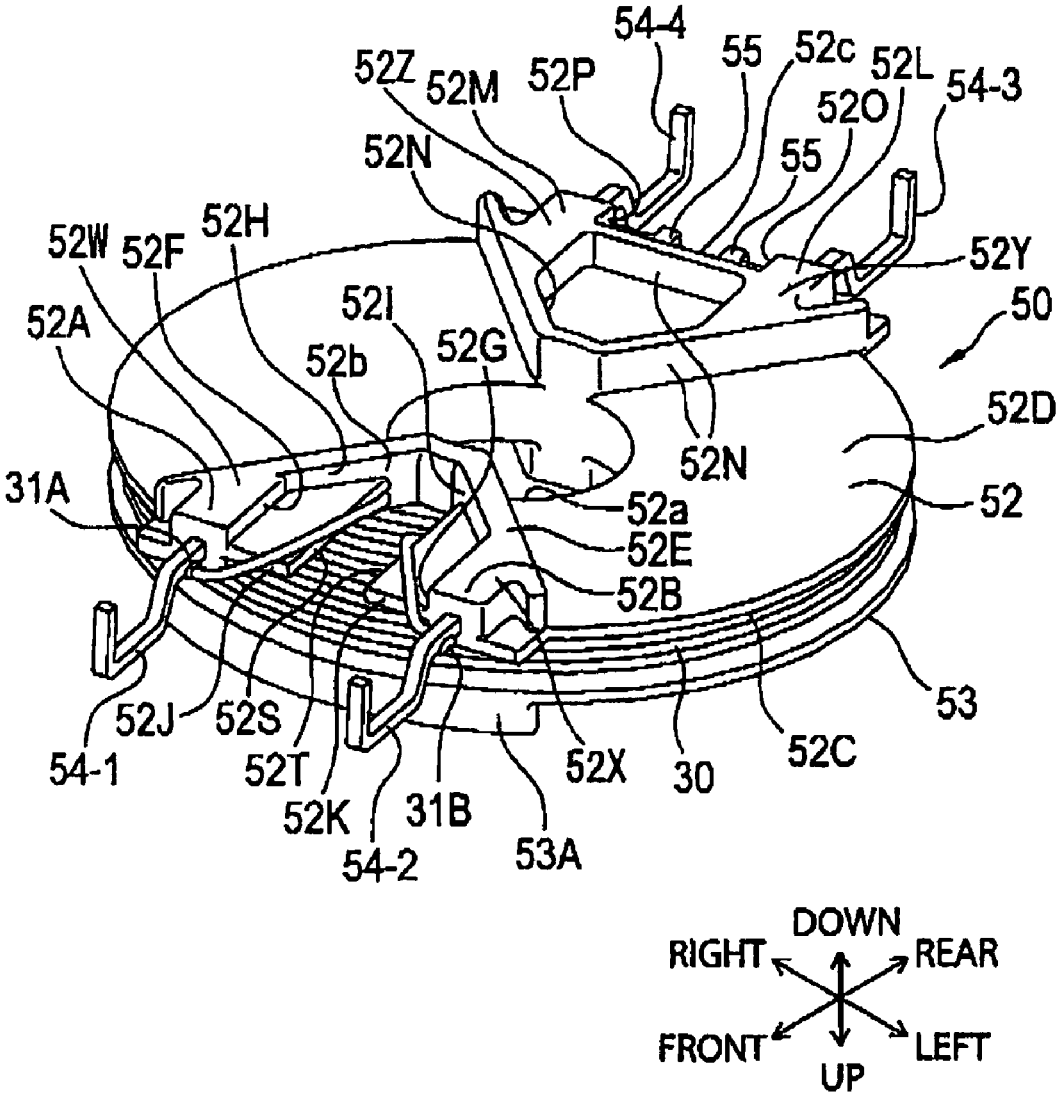
FIG. 3 is a perspective view of a bobbin of the coil component shown in FIG. 1, from a point diagonally below and frontward thereof.
Figure 7:
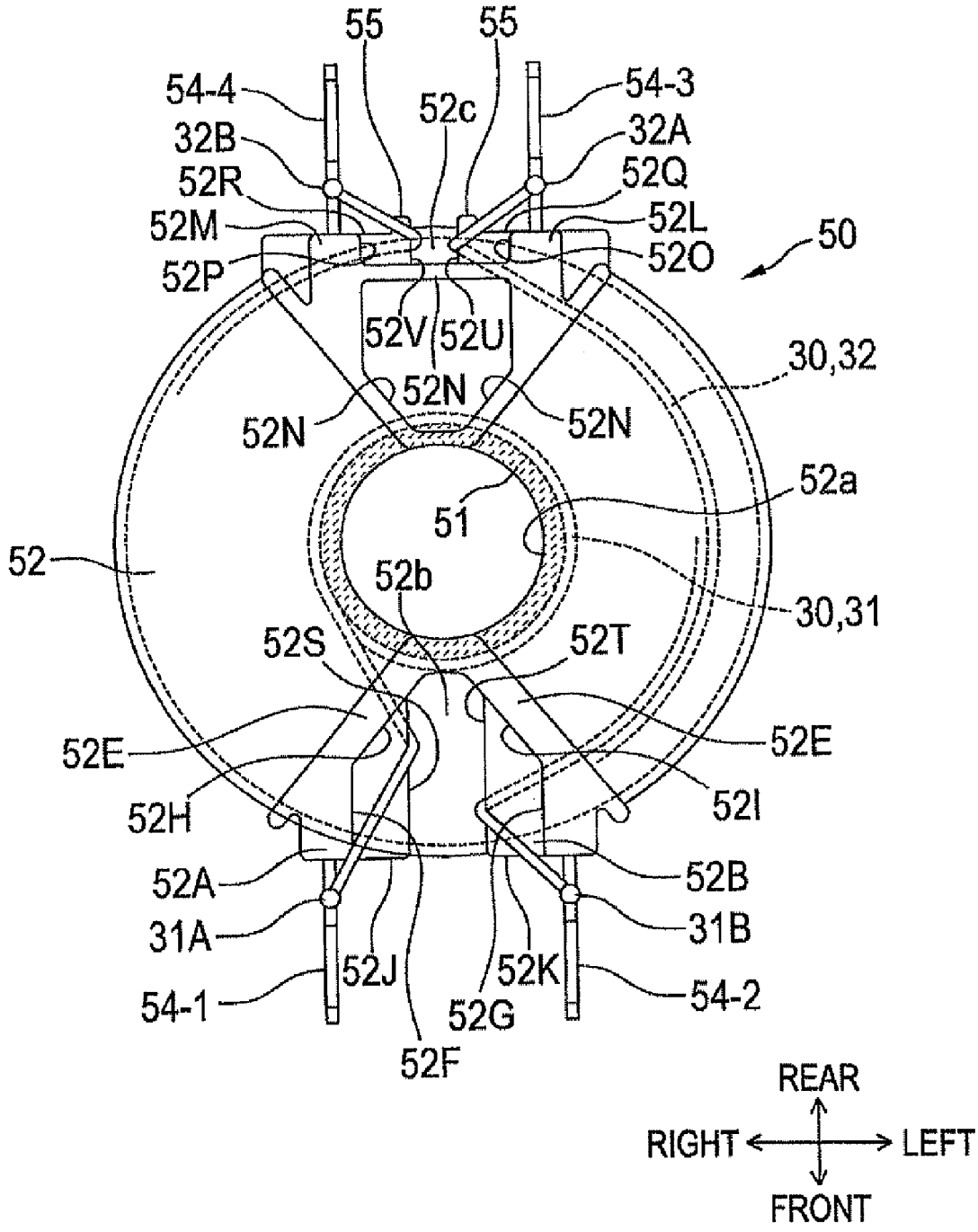
FIG. 7 is a bottom view of the bobbin.

The flange 52 has an upper surface 52C and a lower surface 52D. As shown in FIG. 3, the flange 52 is formed with notches 52*b* and 52*c* on diametrically opposing sides thereof. The notch 52*b* extends from a peripheral edge of the flange 52 to a point near the through-hole 52*a*. As shown in FIG. 7, the notch 52*b* has a rectangular part near the periphery of the flange 52 and a trapezoidal part near the through-hole 52*a*.

As shown in FIG. 3, the flange 52 is integrally formed with terminal-mounting parts 52A, 52B, 52L, and 52M protruding downward from the lower surface 52D. Thus, regions of the flange 52 where the terminal-mounting parts 52A, 52B, 52L, and 52M are provided are formed thicker than the remaining regions thereof with respect to the up-down direction.

The terminal-mounting parts 52A and 52B confront each other across the notch 52*b*, and have first notch-defining walls 52F and 52G opposing each other. The first notch-defining walls 52F and 52G extend in the front-rear direction and define the rectangular part of the notch 52*b* therebetween.

Figure 4:
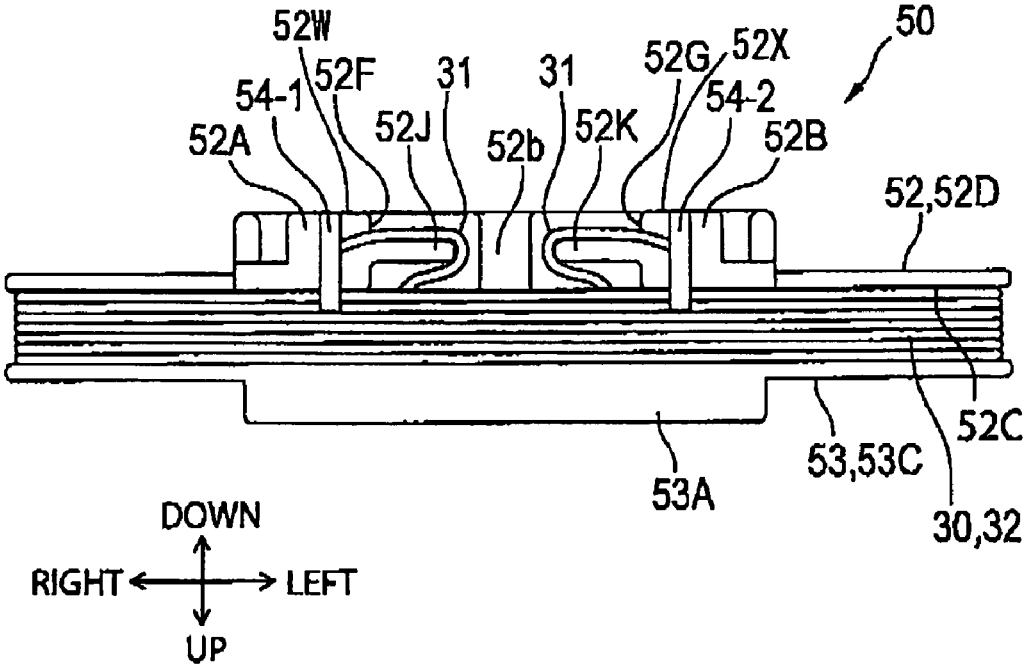
FIG. 4 is a front-side view of the bobbin shown in FIG. 3.

The terminal-mounting parts 52A and 52B are attached with metallic terminals 54-1 and 54-2 configured of rod-shaped metal brackets having a rectangular cross section taken orthogonal to the longitudinal direction thereof. Specifically, the metallic terminals 54-1 and 54-2 are fixed at base ends thereof to the terminal-mounting parts 52A and 52B through insert molding, and extend frontward from the base ends thereof, bend to extend substantially upward, bend again to extend frontward, and finally bend at a right angle to extend downward. Endfaces of the metallic terminals 54-1 and 54-2 facing downward are flush with lower surfaces 52W and 52X, respectively, of the corresponding terminal-mounting parts 52A and 52B, respectively, as shown in FIG. 4.

As shown in FIG. 3, the flange 52 is also provided with a reinforcing rib 52E that extends in an approximate V-shape from the peripheral edge of the flange 52 to the through-hole 52*a* and back to the peripheral edge of the flange 52. The reinforcing rib 52E extends in the up-down direction to the same height as the first notch-defining walls 52F and 52G, and has second notch-defining walls 52H and 52I defining the trapezoidal part of the notch 52*b*.

Note that the first notch-defining walls 52F and 52G and the second notch-defining walls 52H and 52I correspond to edges of the flange 52 that define the notch 52*b*.

The flange 52 is further provided with wire-supporting parts 52J and 52K at the notch 52*b*. The wire-supporting parts 52J and 52K are disposed at center positions of the first notch-defining walls 52F and 52G and the second notch-defining walls 52H and 52I in the up-down direction. Because the wire-supporting parts 52J and 52K are substantially plate-shaped and thinner than the height of the first notch-defining walls 52F and 52G in the up-down direction, the wire-supporting parts 52J and 52K are at positions lower than the upper surface 52C of the flange 52 and higher than the lower surfaces 52W and 52X, respectively, of the terminal-mounting parts 52A and 52B, respectively. The distance between the lower surfaces of the terminal-mounting parts 52A and 52B and the wire-supporting parts 52J and 52K in the up-down direction is identical to the distance between the upper surface 52C of the flange 52 and the wire-supporting parts 52J and 52K. These distances are greater than the diameters of a first wire 31 and a second wire 32 described later.

The wire-supporting parts 52J and 52K have upper and lower surfaces parallel to the upper surface 52C of the flange 52. As shown in FIG. 7, the wire-supporting parts 52J and 52K extend from the peripheral edge of the flange 52 along the entire notch-defining walls 52F and 52Gb to a midpoint of the respective second notch-defining walls 52H and 52I near the through-hole 52*a*, and oppose each other in the right-left direction. The wire-supporting parts 52J and 52K have edges 52S and 52T extending parallel to each other and separated in the right-left direction.

Figure 5:
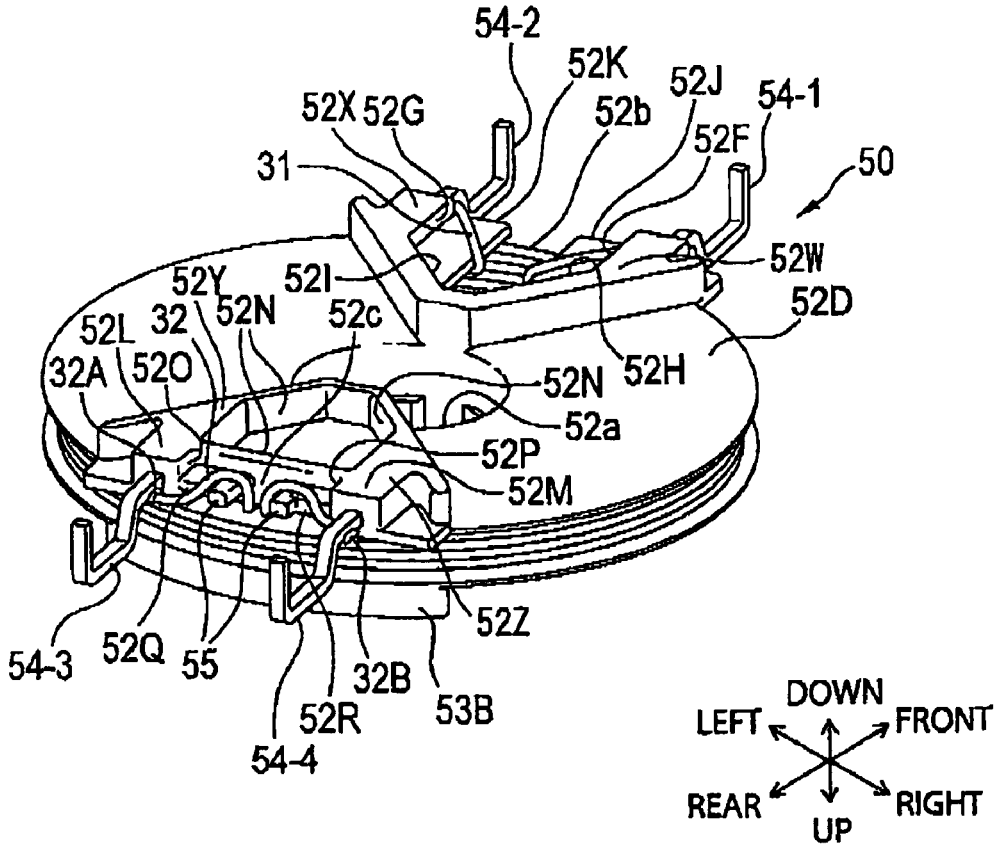
FIG. 5 is a perspective view of the bobbin from a point diagonally below and rearward thereof.

As shown in FIG. 5, the terminal-mounting parts 52L and 52M confront each other across the notch 52*c* and have first notch-defining walls 52O and 52P corresponding to edges in the circumferential direction of the flange 52 that define the notch 52*c*.

Figure 6:
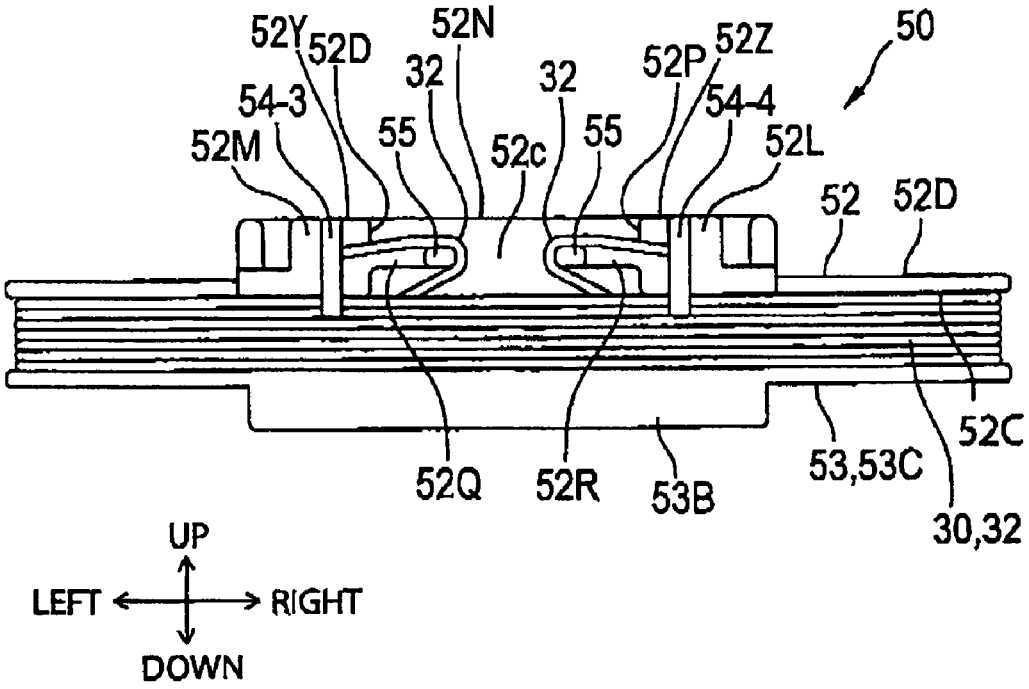
FIG. 6 is a rear-side view of the bobbin.

The terminal-mounting parts 52L and 52M are attached with metallic terminals 54-3 and 54-4, respectively. As with the metallic terminals 54-1 and 54-2 described above, the metallic terminals 54-3 and 54-4 are configured of rod-shaped metal brackets having a rectangular cross section taken orthogonal to the longitudinal direction thereof. The metallic terminals 54-3 and 54-4 are fixed at base ends thereof to the terminal-mounting parts 52L and 52M through insert molding, and extend rearward from the base ends thereof, bend to extend substantially upward, bend again to extend rearward, and finally bend at a right angle to extend downward. Endfaces of the metallic terminals 54-3 and 54-4 are flush with the lower surfaces 52Z and 52Y, respectively, of the corresponding terminal-mounting parts 52L and 52M, respectively, as shown in FIG. 6.

As shown in FIG. 7, the notch 52*c* extends from the peripheral edge of the flange 52 toward the through-hole 52*a* to a prescribed position and is rectangular in shape in a bottom view.

The first notch-defining walls 52O and 52P of the terminal-mounting parts 52L and 52M extend along the front-rear direction and defines the notch 52*c* therebetween near the periphery of the flange 52.

As shown in FIG. 5, the flange 52 is also provided with a reinforcing rib 52N having a part extending in the right-left direction defining a front wall of the notch 52*c* and a substantially V-shaped part extending from the peripheral edge of the flange 52 to the through-hole 52*a* and back again to the peripheral edge of the flange 52. The reinforcing rib 52N extends upward to the same height as the first notch-defining walls 52O and 52P.

The flange 52 is also provided with wire-supporting parts 52Q and 52R disposed at center positions on the first notch-defining walls 52O and 52P in the up-down direction so as to span the entire notch-defining walls 52O and 52P in the front-rear direction as shown in FIG. 7. Because the wire-supporting parts 52Q and 52R are substantially plate-shaped and formed thinner than the height of the first notch-defining walls 52O and 52P in the up-down direction, the wire-supporting parts 52Q and 52R are at positions lower than the upper surface 52C of the flange 52 and higher than the lower surfaces 52Z and 52Y, respectively, of the terminal-mounting parts 52L and 52M, respectively, as shown in FIG. 6.

The wire-supporting parts 52O and 52R are disposed away from and oppose each other in the right-left direction, and has top and bottom surfaces parallel to the upper surface 52C of the flange 52 and edges 52U and 52V (FIG. 7) opposing each other. Each of the wire-supporting parts 52Q and 52R is provided with a protruding part 55 at a rear end thereof, which is a position equivalent to the periphery of the flange 52. The protruding parts 55 protrude parallel to each other in a direction away from the through-hole 52*a*, i.e., rearward. Opposing surfaces of the protruding parts 55 are flush with the edges 52U and 52V, thereby extending the edges 52U and 52V in a direction away from the through-hole 52*a*.

As shown in FIG. 2, substantially fan-shaped ribs 53A and 53B are provided on an upper surface 53C of the flange 53 to protrude upward, thereby increasing the thickness of the flange 53 in the up-down direction. The ribs 53A and 53B are provided at diametrically opposing positions on either front or rear side of the through-hole 53*a*, and substantially fan-shaped contours of the ribs 53A and 53B substantially match notches 12*a* formed in the second magnetic core 12. Accordingly, when the coil component 1 is assembled as shown in FIG. 1, the ribs 53A and 53B are fitted into the notches 12*a* of the second magnetic core 12. A center rib 53E is provided inside the rib 53B at a position aligned with the notch 52*c* (FIG. 3) of the flange 52. The center rib 53E extends in a radial direction of the flange 53 so as to bisect the rib 53B in the circumferential direction. The ribs 53A and 53B and the center rib 53E function to reinforce the flange 53.

The wires 30 include the first wire 31 and the second wire 32 (FIG. 5), which are insulated copper wires. The first wire 31 has a larger diameter than the second wire 32. As shown in FIG. 3, the first wire 31 has a first end 31A and a second end 31B. The first end 31A is electrically connected by solder to a part of the metallic terminal 54-1 extending frontward from the base end thereof.

The first wire 31 is extended from the first end 31A into a lower part of the notch 52*b* beneath the wire-supporting part 52J and is hooked around the edge 52S of the wire-supporting part 52J located to the left of the metallic terminal 54-1. After passing through an upper part of the notch 52*b* above the wire-supporting part 52J, the first wire 31 is run on the upper surface 52C of the flange 52.

As shown in FIG. 7, the first wire 31 is further run to the core 51, wound about the core 51, inserted into a lower part of the notch 52*b* beneath the wire-supporting part 52K, routed around the edge 52T of the wire-supporting part 52K to an upper part of the notch 52*b* above the wire-supporting part 52K, and run to the metallic terminal 54-2 located to the left side of the edge 52T. The second end 31B of the first wire 31 is electrically connected to a part of the metallic terminal 54-2 extending frontward from the base end thereof.

The second wire 32 is run similar to the first wire 31 described above. Specifically, as shown in FIGS. 5 and 7, a first end 32A of the second wire 32 is electrically connected to a part of the metallic terminal 54-3 extending rearward from the base end thereof. Then, the second wire 32 is run through a lower part of the notch 52*c* beneath the wire-supporting part 52Q and routed over the edge 52U of the wire-supporting part 52Q to an upper part of the notch 52*c* above the wire-supporting part 52Q.

Then, the second wire 32 is run onto the upper surface 52C of the flange 52 and further to the core 51, wound over the first wire 31 already wound about the core 51, inserted into an upper part of the notch 52*c* above the wire-supporting part 52R, routed around the edge 52V of the wire-supporting part 52R to a lower part of the notch 52*c* beneath the wire-supporting part 52R, and run to the metallic terminal 54-4. A second end 32B of the second wire 32 is electrically connected to a part of the metallic terminal 54-4 extending rearward from the base end thereof.

As described above, according to the present embodiment, the first wire 31 is hooked around the edges 52S and 52T of the wire-supporting parts 52J and 52K disposed in the notch 52*b*. This configuration prevents segments of the first wire 31 that run from the notch 52*b* onto the upper surface 52C of the flange 52 from being bent at a large angle and largely protruding upward from the upper surface 52C. Therefore, it is possible to reduce a bulge formed when winding the first wire 31 and the second wire 32 about the core 51.

Further, parts of the first wire 31 extending between either the wire-supporting part 52J or 52K and the upper surface 52C of the flange 52 are accommodated inside the notch 52*b*. Hence, when winding the first wire 31 or the second wire 32 about the core 51, it is possible to prevent the portion of the first or second wire 31 or 32 to be wound about the core 51 from contacting the part of the first wire 31 accommodated in the notch 52*b*, and this minimizes parts of the first wire 31 and the second wire 32 wound about the core 51 that bulge in the axial direction of the core 51. Consequently, it is possible to minimize problems in the winding alignment of the first wire 31 and the second wire 32 about the core 51 and, hence, minimize the winding space that is wasted.

Further, as shown in FIG. 4, the wire-supporting parts 52J and 52K are positioned between the upper surface 52C of the flange 52 and the lower surfaces 52W and 52X, respectively, of the terminal-mounting parts 52A and 52B, respectively. Accordingly, it is possible to minimize segments of the first wire 31 near the first and second ends 31A and 31B that protrude either upward or downward beyond the upper surface 52C of the flange 52 or the lower surfaces 52W and 52X, respectively,of the terminal-mounting parts 52A and 52B, respectively.

Similarly, the second wire 32 is hooked around the edges 52U and 52V of the wire-supporting parts 52Q and 52R disposed in the notch 52*c*. This configuration prevents segments of the second wire 32 that run from the notch 52*c* onto the upper surface 52C of the flange 52 from being bent at a large angle and largely protruding upward from the upper surface 52C of the flange 52. Therefore, it is possible to reduce a bulge formed when winding the second wire 32 about the core 51.

Further, parts of the second wire 32 extending between either the wire-supporting part 52Q or 52R and the upper surface 52C of the flange 52 are accommodated inside the notch 52*c*. Hence, when winding the second wire 32 about the core 51, it is possible to prevent the portion of the second wire 32 to be wound about the core 51 from contacting the parts of the second wire 32 accommodated in the notch 52*c*, and this minimizes parts of the second wire 32 wound about the core 51 that bulge in the axial direction of the core 51. Consequently, it is possible to minimize problems in the winding alignment of the second wire 32 about the core 51 and, hence, minimize the winding space that is wasted.

Also, because the wire-supporting parts 52Q and 52R are positioned between the upper surface 52C of the flange 52 and the lower surfaces of the terminal-mounting parts 52L and 52M as shown in FIG. 6, it is possible to minimize segments of the wires 31 and 32 near the ends 31A, 32A, 31B, and 32B that protrude in either upward or downward from the upper surface 52O or the lower surfaces 52Z and 52Y, respectively, of the terminal-mounting parts 52L and 52M, respectively.

Accordingly, it is possible to use a relatively short core as the core 51 of the coil component 1, enabling to reduce the height of the coil component 1. Thus, the present invention is particularly useful when using the coil component 1 as a transformer that requires the core to be short in the axial dimension.

In the present embodiment, the protruding parts 55 are provided on the wire-supporting parts 52Q and 52R so as to extend the edges 52U and 52V in a direction away from the through-hole 52*a*. Therefore, the second wire 32 can be routed smoothly over the protruding parts 55 even when the edges 52U and 52V are relatively short in length.

Also, as described above, the distance between the lower surfaces 52W and 52X, respectively,of the terminal-mounting parts 52A and 52B, respectively, and the wire-supporting parts 52J and 52K and the distance between the upper surface 52O of the flange 52 to the wire-supporting parts 52J and 52K are greater than the diameters of the first and second wires 31 and 32. Accordingly, a segment of the first wire 31 near the first end 31A and a segment near the second end 31B can be accommodated in the notch 52*b* so that no parts of these segments protrude therefrom.

While a coil component according to the present invention has been described in detail with reference to a specific embodiment thereof, it would be apparent to those skilled in the art that many modifications and variations may be made therein without departing from the spirit of the invention, the scope of which is defined by the attached claims.

Figure 8:
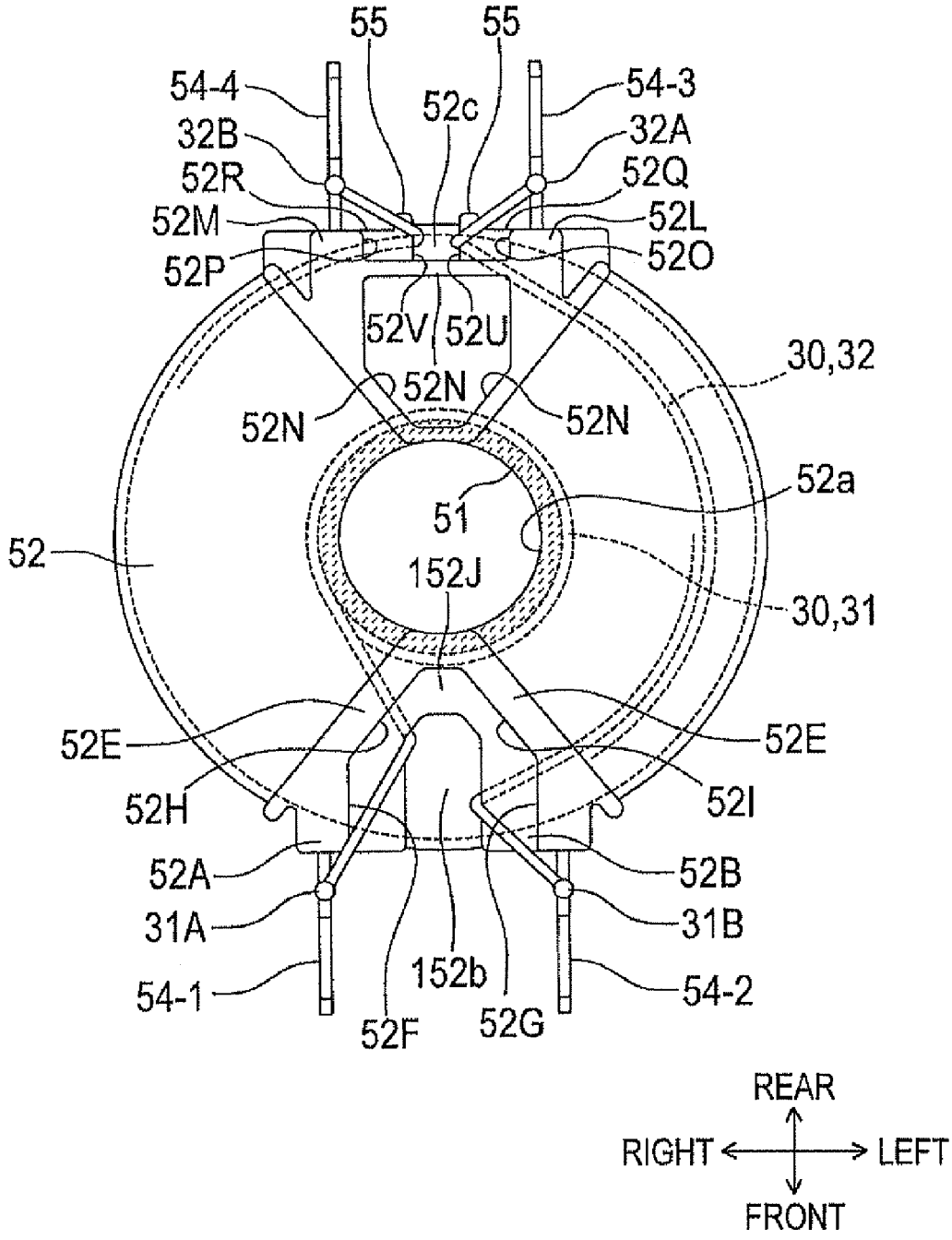
FIG. 8 is a bottom view of a bobbin of a coil component according to a modification of the embodiment.

For example, as shown in FIG. 8, the flange 52 may be provided with, instead of the wire-supporting parts 52J and 52K, a wire-supporting part 152J disposed along the entire notch-defining walls 52F and 52G and the second notch-defining walls 52H and 52I to define a notch 152*b*. This configuration increases the freedom for selecting a position at which the segments of the first wire 31 are routed. Hence, segments of the first wire 31 can be routed around the wire-supporting part 152J so that the first wire 31 runs up onto the upper surface 52C of the flange 52 from the notch 152*b* more gently. Further, this construction reinforces the flange 52.

Figure 9A:
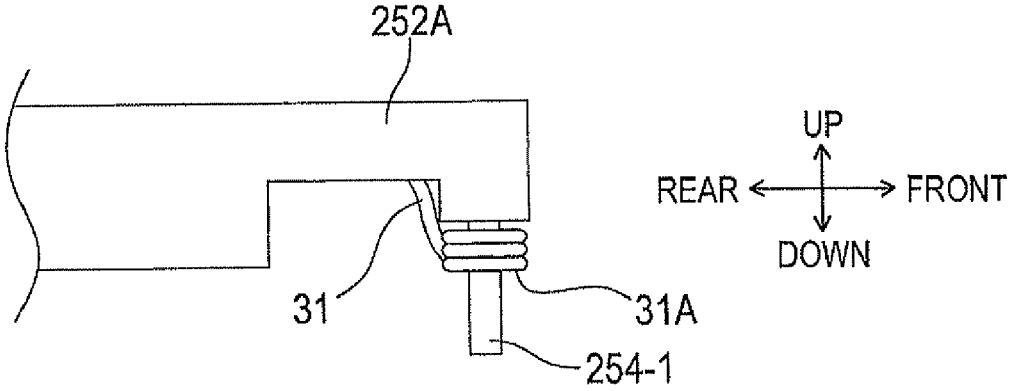
FIG. 9(*a*) is a right-side view of a part of a coil component according to another modification of the embodiment.
Figure 9B:
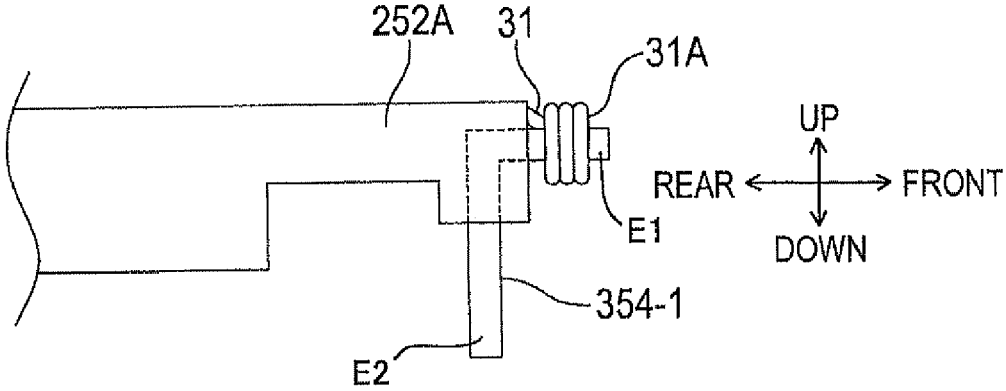

Also, a terminal-mounting part 252A shown in FIG. 9(*a*) may be used instead of the terminal-mounting part 52A or the like shown in FIG. 3. The terminal-mounting part 252A is elongated in the front-rear direction and formed with a recess at a position near a distal end thereof. A linear metallic terminal 254-1, instead of the metallic terminal 54-1 or the like shown in FIG. 3, extends downward from the distal end of the terminal-mounting part 252A, and the first or second end 31A, 31B of the first wire 31 is anchored and electrically connected to the metallic terminal 254-1. Since the metallic terminal 254-1 is linear in shape, a process for bending the metallic terminal 254-1 is unnecessary, helping to reduce manufacturing costs.

Alternatively, a metallic terminal 354-1 bent in an L-shape may be embedded in the terminal-mounting part 252A through insert molding as shown in FIG. 9(*b*) such that a first end part E1 protrudes out of the terminal-mounting part 252A toward the front and that a second end part E2 protrudes downwards, and the first end 31A of the first wire is electrically connected to the first end part E1. Because the first end part E1 does not interfere with the second end part E2, the first end 31A of the first wire 31 can be wound around the first end part E1 without affecting mounting of the coil component 1 on a mounting board (not shown).

Further, the wire-supporting parts 52J, 52K, 52Q, and 52R are not limited to a plate shape, but may be configured in a rod shape, for example. In this case, the longitudinal dimension of the wire-supporting parts 52J, 52K, 52Q, and 52R should be aligned in the direction from the peripheral edge of the flange 52 to the through-hole 52*a*.

Further, while the wire-supporting parts 52J, 52K, 52Q, and 52R in the above-described embodiment are disposed at positions a step higher than the lower surfaces of the terminal-mounting parts 52A, 52B, 52L, and 52M, the wire-supporting parts 52J, 52K, 52Q, and 52R may be disposed such that the lower surfaces 52W, 52X, 52Z, and 52Y, respectively, of the wire-supporting parts 52J, 52K, 52Q, and 52R are flush with the lower surfaces of the 52A, 52B, 52L, and 52M, respectively.

Also, a part of the first wire 31 extending from the first end 31A may be run through the notch 52*b* from the lower part beneath the wire-supporting part 52J to the upper part above the wire-supporting part 52K and then onto the upper surface 52C of the flange 52. Similarly, a part of the first wire 31 extending from the second end 31B may be run through the notch 52*b* from the lower part beneath the wire-supporting part 52K to the upper part above the wire-supporting part 52J and then onto the upper surface 52C of the flange 52.

Similarly, a part of the second wire 32 extending from the first end 32A may be run through the notch 52*c* from the lower part beneath the wire-supporting part 52Q to the upper part above the wire-supporting part 52R and then onto the upper surface 52C of the flange 52, and a part of the second wire 32 extending from the second end 32B may be run through the notch 52*c* from the lower part beneath the wire-supporting part 52R to the upper part above the wire-supporting part 52Q and then onto the upper surface 52C of the flange 52.

Further, the numbers of wires, metallic terminals, terminal-mounting parts, notches, wire-supporting parts, and flanges described in the above embodiment are merely examples, and the present invention is not limited to these numbers.

What is claimed is:

1. A coil component comprising:

a bobbin; and at least one wire, wherein:

the bobbin includes:

a core part formed substantially cylindrical in shape and having an axis of the cylindrical shape and an axial end;

a flange having a first surface on a first side and a second surface on a second side opposite to the first side with respect to a first direction, the first surface being attached to the axial end of the core part;

a plurality of terminal-mounting members, each of the terminal-mounting members being disposed on the flange and having a metallic terminal; and a wire-supporting member protruding from at least one of the terminal-mounting members in a circumferential direction about the axis;

wherein the at least one wire is wound about the core part to form a coil, each of the at least one wire having a first end and a second end, the at least one wire including a particular wire, each of the metallic terminals is in one-to-one correspondence with each of the first and second ends of the at least one wire, and each of the first and second ends of the at least one wire is electrically connected to a corresponding one of the metallic terminals;

the flange is formed with a notch at a position near a first one of the terminal-mounting members, the notch extending from a peripheral edge of the flange toward the core part;

the wire-supporting member is disposed in the notch at a position closer to the second surface than the first surface in the first direction, and extends in a second direction from the peripheral edge of the flange toward the core part, the wire-supporting member opposing the coil in the first direction; and a first segment of the particular wire near the first end thereof extends from the second side to the first side of the flange through the notch and further to the core part, the first segment being hooked around the wire-supporting member in the notch.

2. The coil component according to claim 1, wherein:

the plurality of terminal-mounting members are disposed on the second surface of the flange, and each has a third surface; and the wire-supporting member is disposed in the notch at the position between the first surface of the flange and the third surface of the first one of the terminal-mounting members.

3. The coil component according to claim 1, wherein:

a second one of the terminal-mounting members is disposed at a position near the first one of the terminal-mounting members;

the notch is formed between the first and second ones of the terminal-mounting members;

the wire-supporting member includes a first wire-supporting part disposed on the flange at a position near the first one of the terminal-mounting members and a second wire-supporting part disposed on the flange at a position near the second one of the terminal-mounting members;

the first end of the particular wire is electrically connected to the metallic terminal of the first one of the terminal-mounting members, and the second end of the particular wire is electrically connected to the metallic terminal of the second one of the terminal-mounting members;

the first segment of the particular wire is hooked around the first wire-supporting part in the notch; and a second segment of the particular wire near the second end thereof extends from the second side to the first side of the flange through the notch and further to the core part, the second segment being hooked around the second wire-supporting part in the notch.

4. The coil component according to claim 1, wherein:

a second one of the terminal-mounting members is disposed at a position near the first one of the terminal-mounting members;

the notch is formed between the first and second ones of the terminal-mounting members;

the wire-supporting member includes a first wire-supporting part disposed on the flange at a position near the first one of the terminal-mounting members and a second wire-supporting part disposed on the flange at a position near the second one of the terminal-mounting members;

the first end of the particular wire is electrically connected to the metallic terminal of the first one of the terminal-mounting member, and the second end of the particular wire is electrically connected to the metallic terminal of the second one of the terminal-mounting members;

the first segment of the particular wire is hooked around the second wire-supporting part in the notch; and a second segment of the particular wire near the second end thereof extends from the second side to the first side of the flange through the notch and further to the core part, the second segment being hooked around the first wire-supporting part in the notch.

5. The core component according to claim 1, wherein the flange has a fourth surface defining the notch, and the wire-supporting member is formed along the entire fourth surface of the flange.

6. The core component according to claim 1, wherein:

the wire-supporting member has a first edge around which the first segment of the particular wire is hooked, and a second edge matching a peripheral edge of the flange; and the wire-supporting member is formed with a protrusion on the second edge, the protrusion protruding in a third direction away from the core part so as to extend the first edge in the third direction.

7. The coil component according to claim 1, wherein a distance between the first surface of the flange and the wire-supporting member in the first direction is greater than a diameter of the particular wire.

8. The coil component according to claim 1, further comprising a core that is assembled to the bobbin.

* * * * *